US008004487B2

(12) United States Patent
Tanaka

(10) Patent No.: US 8,004,487 B2
(45) Date of Patent: Aug. 23, 2011

(54) DISPLAY DEVICE

(75) Inventor: Yasuhiro Tanaka, Edogawa (JP)

(73) Assignee: Hitachi Displays, Ltd., Chiba (JP)

( * ) Notice: Subject to any disclaimer, the term of this patent is extended or adjusted under 35 U.S.C. 154(b) by 972 days.

(21) Appl. No.: 11/976,407

(22) Filed: Oct. 24, 2007

(65) Prior Publication Data

US 2008/0129675 A1 Jun. 5, 2008

(30) Foreign Application Priority Data

Oct. 26, 2006 (JP) ..... 2006-290578

(51) Int. Cl.
*G09G 3/36* (2006.01)

(52) U.S. Cl. ..... 345/98; 345/99

(58) Field of Classification Search ..... 345/87–104, 345/204–215, 690–699
See application file for complete search history.

(56) References Cited

U.S. PATENT DOCUMENTS 7,239,300 B2 * 7/2007 Shimizu ..... 345/100
7,821,487 B2 * 10/2010 Tanaka et al. ..... 345/100
2004/0189579 A1 * 9/2004 Shimizu ..... 345/98
2007/0152947 A1 * 7/2007 Tanaka et al. ..... 345/100

FOREIGN PATENT DOCUMENTS

JP 2004-301946 3/2003

* cited by examiner

*Primary Examiner* — Alexander Eisen
*Assistant Examiner* — Patrick F Marinelli
(74) *Attorney, Agent, or Firm* — Stites & Harbison PLLC; Juan Carlos A. Marquez, Esq.

(57) ABSTRACT

The present invention is intended to reduce a peak value of a momentary current, which is generated in a data driver, even when display data items expressing a succeeding display line have changed largely. The data driver includes: an internal control signal production circuit that groups multiple video lines into multiple blocks and produces internal control signals which are used to make the transmission timings of video voltages onto video lines, which belong to the blocks, different from one another among the blocks; a first latch circuit that sequentially latches display data items which express one display line a second latch circuit that latches the display data items which have been latched into the first latch circuit; and a third latch circuit that latches the display data items, which have been latched into the second latch circuit and are associated with the blocks, at timings, responsively to internal control signals.

6 Claims, 15 Drawing Sheets

DISPLAY DEVICE

CLAIM OF PRIORITY

The present application claims priority from Japanese application serial No. 2006-290578, filed on Oct. 26, 2006, the content of which is hereby incorporated by reference into this application.

BACKGROUND OF THE INVENTION

1. Field of the Invention

The present invention relates to a display device, or more particularly, to a technology effectively applied to a data driver.

2. Background Art

Liquid crystal display modules are adopted as high-definition color monitors for computers or other information equipment or display devices for televisions.

The liquid crystal display module includes a so-called liquid crystal display panel having a liquid crystal layer sandwiched between two (a pair of) substrates at least one of which is made of transparent glass. A voltage is selectively applied to various electrodes for image formation which are formed on the substrates of the liquid crystal display panel, whereby predetermined subpixels are lit or extinguished. The liquid crystal display module is superior in a contrast and quickness in display.

In order to light or extinguish subpixels, data drivers and scan drivers are mounted on the flanks of the liquid crystal display panel.

The data driver generally includes a latch that latches display data items received externally and a decoder that converts the display data items, which have been latched into the latch, into video voltages (refer to, for example, patent document 1).

Incidentally, the patent document on a related art of the present invention is JP-A-2004-301946.

As far as the conventional data driver is concerned, when a video voltage (gray-scale voltage) is place on each video line, the video voltage is transmitted onto all video lines at the same timing. However, since the waveform of a scan signal differs between a pixel located near a scan signal input terminal coupled to a scanning line and a pixel located away from it, a time during which a thin-film transistor (TFT) that is an active element remains one varies. This poses a problem in that a video voltage writing time varies.

In order to solve the above problem, video lines are grouped into multiple blocks. The transmission timings of video signals to the respective blocks are differentiated (caused to lag), whereby non-uniformity in display or degradation in display quality, due to writing failure of data can be prevented.

However, the latch in the data driver comprehensively latches data items synchronously with a transmission timing control clock (CL1).

Therefore, when display data representing a succeeding display line has changed largely from display data representing a preceding line, since numerous circuits operate comprehensively, there arises a fear that a momentary current may be generated. The momentary current brings variation of a power supply voltage and thereby noise is superimposed to the power supply voltage, at the worst, there is a fear that display data may be lost or reliability may be impaired.

SUMMARY OF THE INVENTION

The present invention attempts to solve the problems underlying the related art. An object of the present invention is to provide a technology that decreases the peak value of a momentary current generated in a data driver even when display data representing a succeeding display line has changed largely and that thus improves the reliabilities of the data driver and a display device alike.

The object of the present invention, another objects thereof, and novel features thereof will be apparent from the description of the specification and the appended drawings.

The typical aspects of the present invention will be described briefly below.

(1) A display device includes a display panel having multiple video lines laid therein, data drivers that transmit a video voltage onto the respective video lines, and a display control circuit that controls or drives the data drivers. The data driver includes: an internal control signal production circuit that groups the multiple video lines into multiple blocks and produces internal control signals which are used to make the transmission timings of video voltages onto the video lines, which belong to the blocks, different from one another among the blocks; a first latch circuit that sequentially latches display data items which are successively received externally and express one display line; a second latch circuit that latches the display data items latched into the first latch circuit; a third latch circuit that latches the display data items, which have been latched into the second latch circuit and associated with the blocks, at timings that are different from one another among the blocks; and a decoder that converts the display data items, which have been latched into the third latch circuit, into video voltages. The second latch circuit latches the display data items, which have been latched into the first latch circuit, at timings different from one another among the blocks.

(2) In relation to paragraph (1), before the first latch circuit latches succeeding display data items that are associated with the blocks, the second latch circuit latches display data items that have been latched into the first latch circuit. Before the second latch circuit latches succeeding display data items received from the first latch circuit, the third latch circuit latches display data items that have already been latched into the second latch circuit.

(3) In relation to paragraph (1) or (2), the first latch circuit latches display data items responsively to fetch signals. The second latch circuit latches the display data items, which have been latched into the first latch circuit, responsively to first internal control signals produced by the internal control signal production circuit. The third latch circuit latches the display data items, which have been latched into the second latch circuit, responsively to the second internal control signals produced by the internal control signal production circuit. The first internal control signals are signals that are synchronous with whichever of the fetch signal, responsively to which the last display data among display data items associated with the blocks is latched, and the second internal control signals, responsively to which the display data items associated with the blocks are latched, that is invalidated last.

(4) In relation to paragraph (3), the first internal control signals are signals that rise synchronously with the trailing edge of the fetch signal, responsively to which the last display data among the display data items associated with the blocks is latched, and fall synchronously with a transmission timing control clock.

(5) In relation to paragraph (3), the first internal control signals are signals that rise synchronously with the trailing edges of the second internal clocks, responsively to which the display data items associated with the blocks are latched, and fall synchronously with the transmission timing control clock.

(6) In relation to any of paragraphs (1) to (5), the display panel includes multiple scan lines and scan drivers that transmit a scan signal onto each of the scan lines. The internal control signal production circuit causes the transmission timings of the video voltages to lag in sequence from a block located near each scan driver to a block located away from the scan driver.

(7) In relation to any of paragraphs (1) to (5), the display device is a liquid crystal display device, and the display panel is a liquid crystal display panel.

Advantages provided by the typical aspects of the present invention will be described below.

According to the present invention, even when display data items expressing a succeeding display line have changed greatly, the peak value of a momentary current generated in a data driver can be minimized. The reliabilities of the data driver and a display device alike can be improved.

DESCRIPTION OF THE PREFERRED EMBODIMENT

Figure 1:
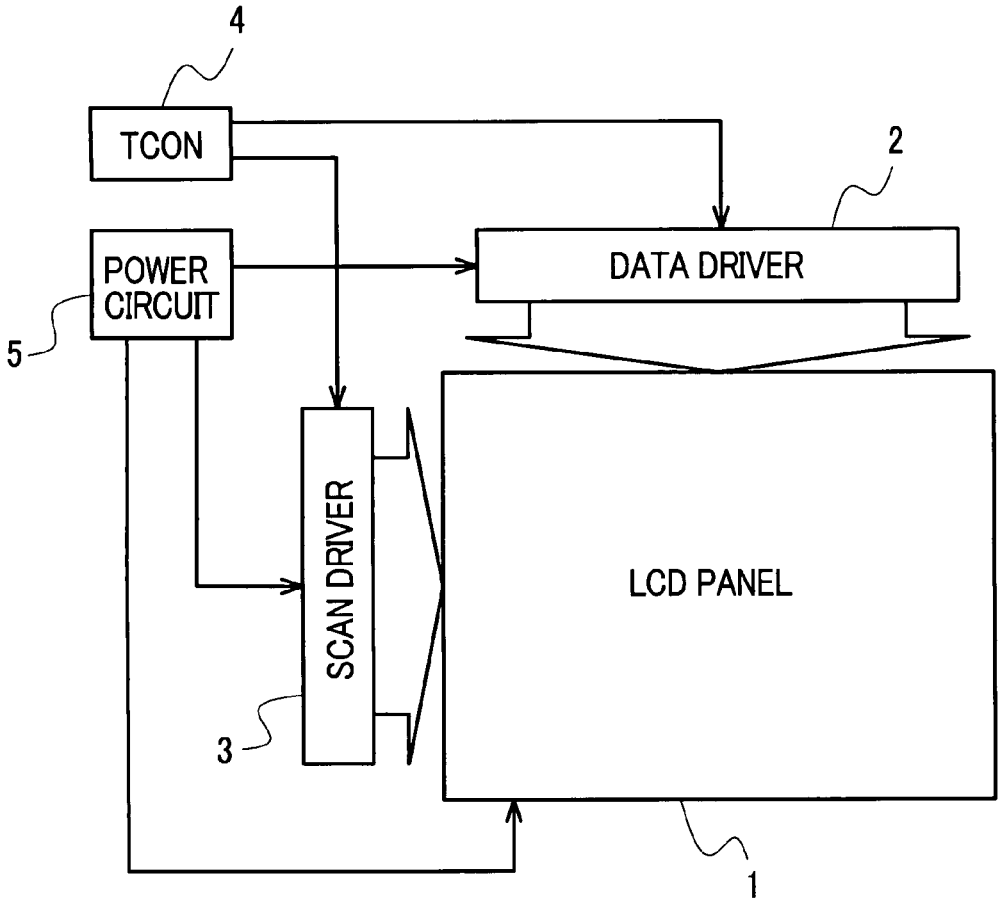
FIG. 1 is a block diagram showing the outline configuration of a liquid crystal display module in accordance with an embodiment of the present invention.

Referring to the drawings, the present invention will be described below in relation to an embodiment.

In all the drawings to be referred to for a description of the embodiment, the same reference numerals are assigned to components having identical capabilities. An iterative description will be omitted.

Embodiment

FIG. 1 is a block diagram showing the outline configuration of a liquid crystal display module in accordance with an embodiment of the present invention.

The liquid crystal display module in accordance with the embodiment includes a liquid crystal display panel 1, a data driver unit 2, a scan driver unit 3, a display control circuit (TCON) 4, and a power circuit 5.

The data driver unit 2 and scan driver unit 3 are disposed on the perimeter of the display panel 1. The scan driver unit 3 includes multiple scan driver ICs disposed on one side of the liquid crystal display panel 1. Moreover, the data driver unit 2 includes multiple data driver ICs disposed on other side of the liquid crystal display panel 1.

The display control circuit 4 transforms a display signal, which is received from a display signal source (host) such as a personal computer or a reception circuit, into display data conformable to a display format by placing data on an alternating voltage or adjusting timings optimally for display on the liquid crystal display panel 1. Thus, the display signal is transferred together with a synchronizing (sync) signal (clock signal) to each of the scan driver unit 3 and data driver unit 2.

The scan driver unit 3 and data driver unit 2 feed a scan voltage to the scan lines under the control of the display control circuit 4. Moreover, a video voltage is fed to the video lines in order to display a picture. The power circuit 5 generates various voltages needed in the liquid crystal display device.

Figure 2:
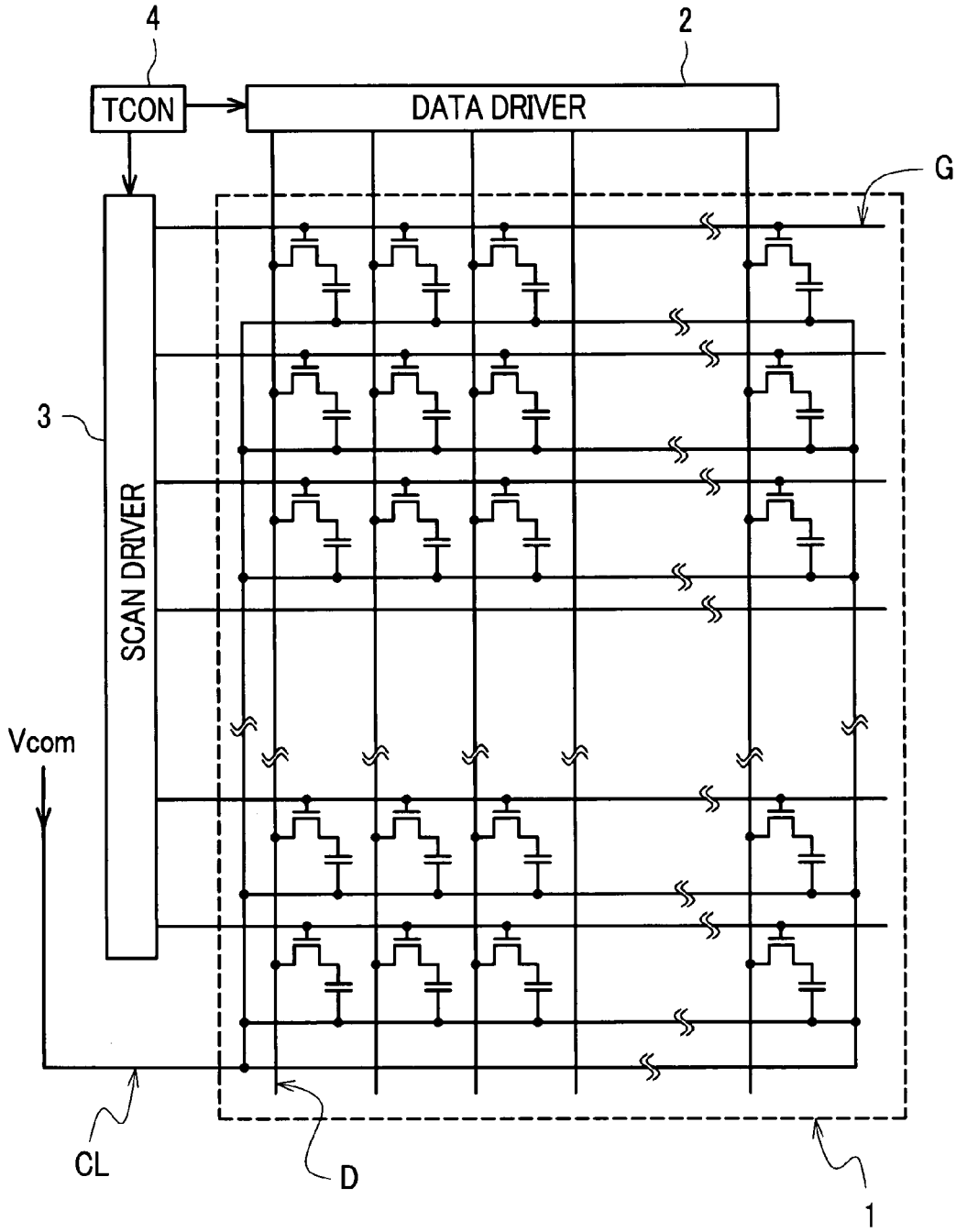
FIG. 2 shows an equivalent circuit of a pixel area included in a liquid crystal display panel of the embodiment of the present invention.

FIG. 2 shows an equivalent circuit of a pixel area included in the liquid crystal display panel 1 in accordance with the embodiment. The drawing shows an actual geometric array of pixels. Each of multiple subpixels arrayed in the form of a matrix in an effective display area (pixel area) is formed with one thin-film transistor (TFT).

Figure 3:
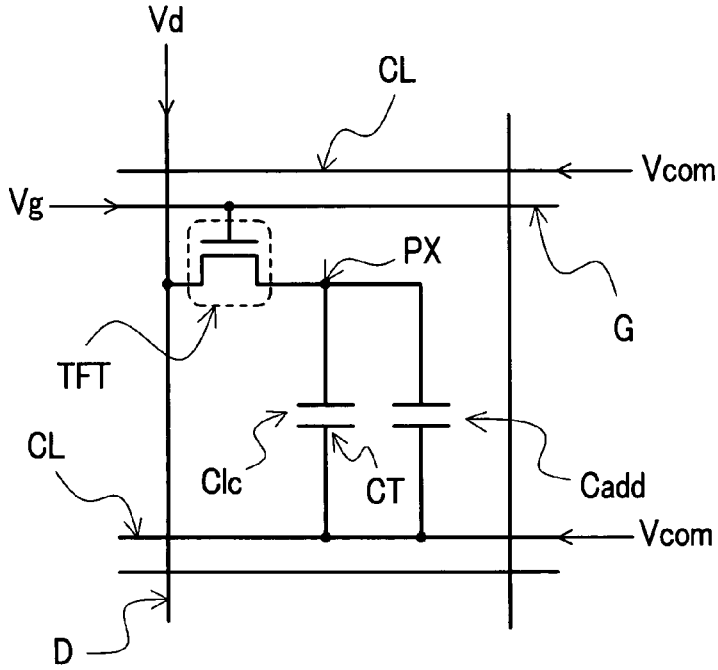
FIG. 3 shows an equivalent circuit of a subpixel included in the liquid crystal display panel of the embodiment.

FIG. 3 shows an equivalent circuit of a subpixel included in the liquid crystal display panel 1 in accordance with the present embodiment.

In FIG. 3, there are shown video lines (may be called drain lines or source lines) D, scan lines (may be called gate lines) G, a pixel electrode PX, an opposite electrode (common electrode) CT, a liquid crystal capacitor Clc equivalent to a liquid crystal layer, and a holding capacitor Cadd formed between a common signal line (CL) to which a voltage Vcom is applied and a source electrode.

As shown in FIG. 2, the drain electrodes of thin-film transistors (TFTs) that serve as subpixels and are disposed in a column are connected to each video line D. The video lines D are coupled to the data driver unit 2 that feeds a video voltage, which represents display data, to the subpixels disposed in columns.

The gate electrodes of thin-film transistors (TFTs) that serve as subpixels and are disposed in a row are connected to each scanning line G. The scanning lines G are coupled to the scan driver unit 3 that feeds a scan voltage (positive or negative bias voltage) to the gates of the thin-film transistors (TFTs) for one horizontal scanning time.

When an image is displayed on the liquid crystal display panel 1, the scan driver unit 3 sequentially selects the scan lines G from up to down (or from down to up). During a period during which a certain scan line is selected, the data driver unit 2 feeds a video voltage, which represents display data, to the video lines so that the video voltage will be applied to each of the pixel electrodes PX.

A voltage fed to each video line D is applied to the pixel electrode PX by way of the thin-film transistor (TFT). Finally, the hold capacitor Cadd and liquid crystal capacitor Clc are charged. An image is displayed by controlling liquid crystal-line molecules.

Figure 4:
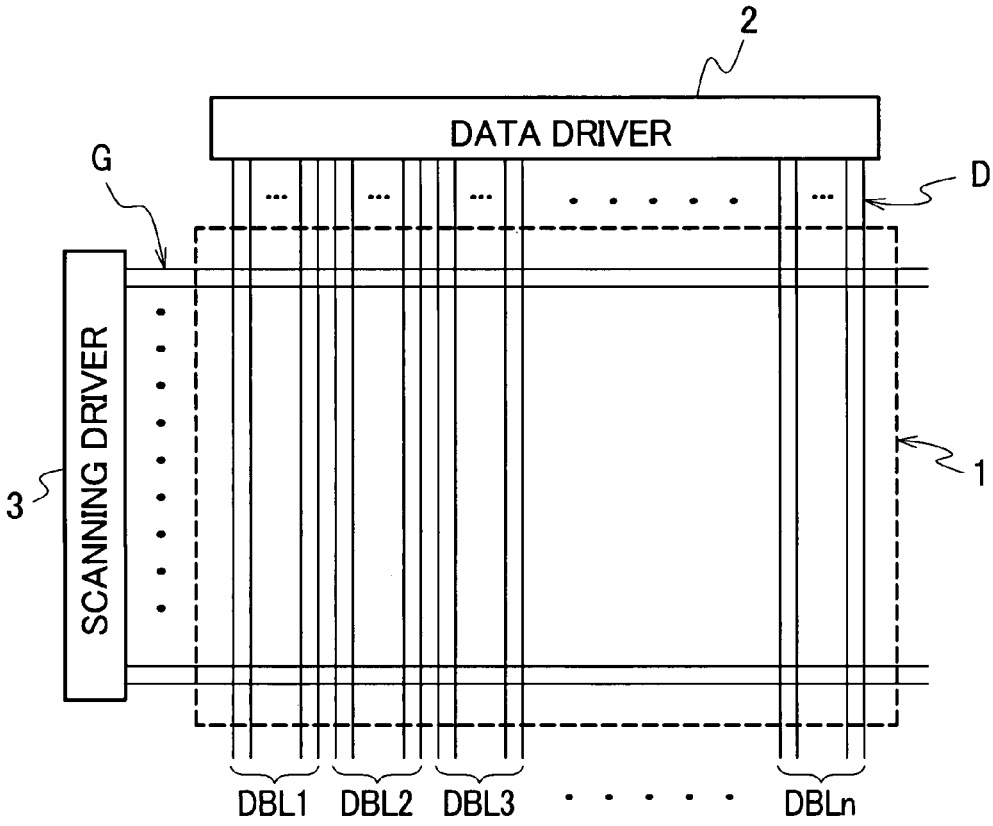
FIG. 4 is an explanatory diagram concerning a method of grouping video lines in the liquid crystal display module in accordance with the embodiment of the present invention.
Figure 5:
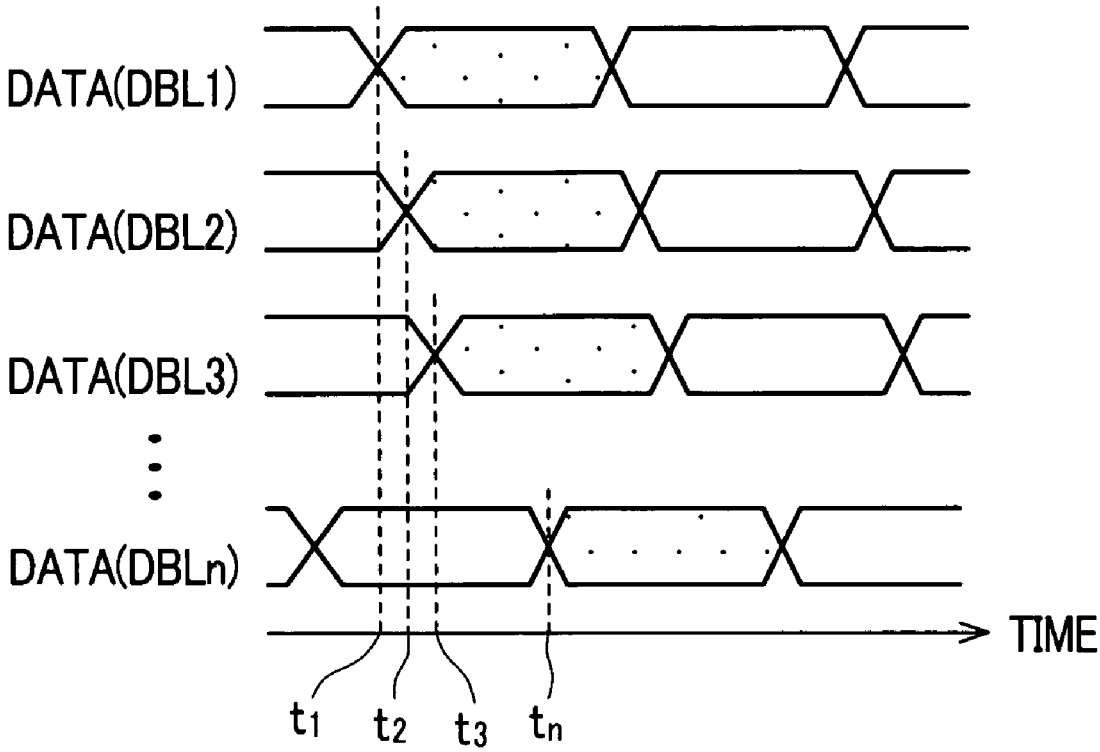
FIG. 5 is an explanatory diagram concerning a method of transmitting a video voltage in the liquid crystal display module in accordance with the embodiment of the present invention.
Figure 6:
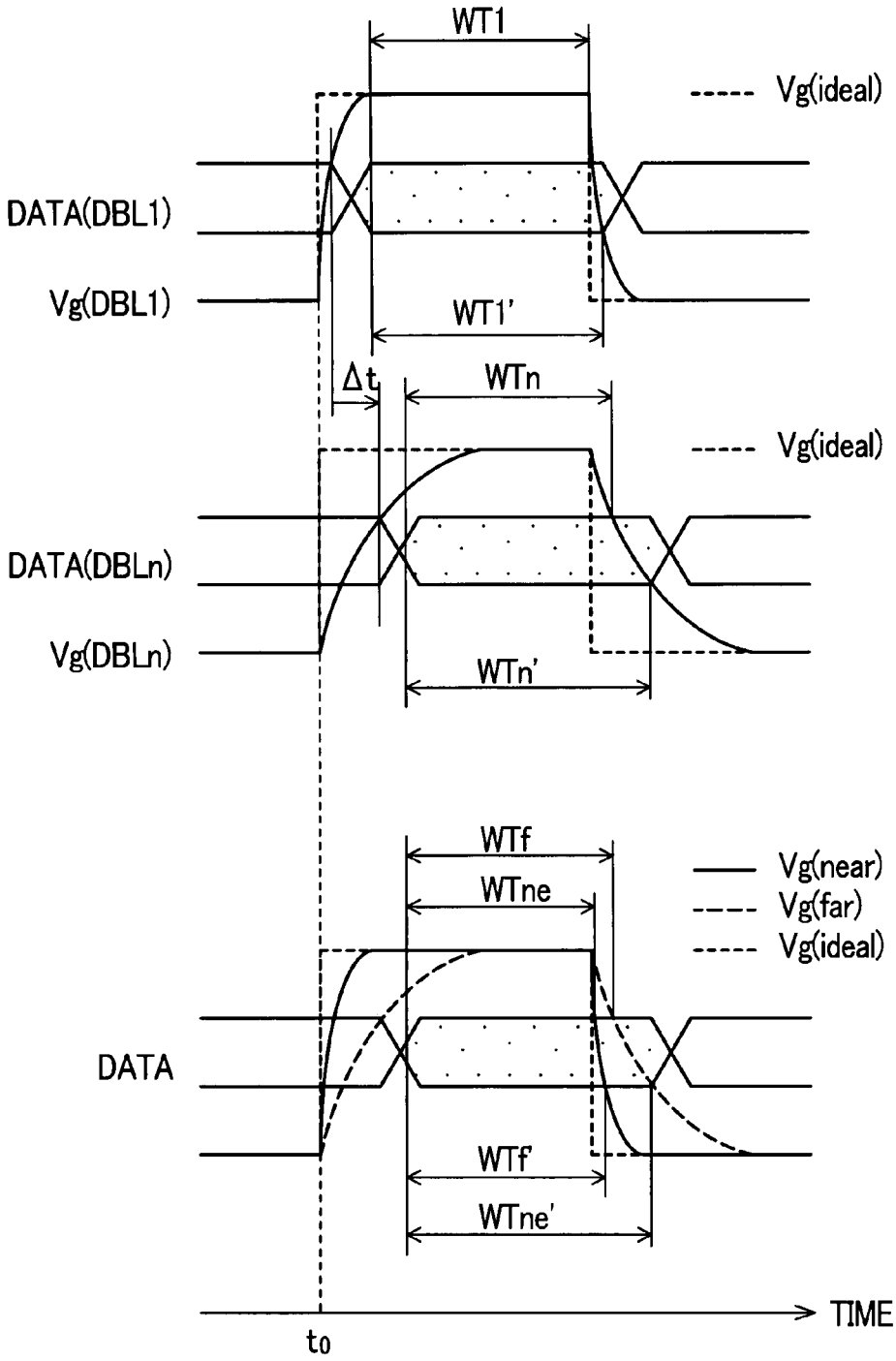
FIG. 6 is an explanatory diagram concerning a method of designating a lag value in the liquid crystal display module in accordance with the embodiment of the present invention.

FIG. 4 is an explanatory diagram concerning a method of grouping the video lines included in the liquid crystal display module in accordance with the present embodiment. FIG. 5 is an explanatory diagram concerning a method of transmitting a video voltage in the liquid crystal display module in accordance with the present embodiment. FIG. 6 is an explanatory diagram concerning a method of designating a lag value in the liquid crystal display module in accordance with the present embodiment.

The liquid crystal display module in accordance with the present embodiment is designed in order to prevent occurrence of a variance in a writing time, during which a video voltage is written in each of the subpixels juxtaposed in a direction in which each of the scan lines G is extended, in the liquid crystal display panel 1.

Therefore, in the liquid crystal display module in accordance with the present embodiment, for example, as shown in FIG. 4, the multiple video lines D laid in the liquid crystal display panel 1 are grouped into multiple blocks DBL1 to DBLn. When the data driver unit 2 transmits a video voltage (gray-scale voltage) to each of the video lines D, the transmission timing of the video voltage is, as shown in FIG. 5, shifted for each of the blocks DBL1 to DBLn.

Specifically, as shown in FIG. 5, the transmission timings of video voltages are caused to lag in sequence from the block DBL1 located closest to the input terminal (of the scan driver unit 3) coupled to each scan line G to the block DBLn located farthest away from the input terminal.

A lag value (lag time) by which the transmission timings of video voltages are caused to lag is designated based on the degree of deformation of the waveform of a scan signal on each scan line G within each of the blocks DBL2 to DBLn.

The ideal waveform of a scan signal fed onto each scan line G is rectangular like the ideal waveform Vg indicated with a dot line in FIG. 6. However, since the scan line G is regarded as a kind of distributed constant circuit, the scan signal fed from the scan driver unit 3 onto the scan line G has the waveform thereof deformed by the instant when the scan signal reaches an area in each block.

The waveform Vg(DBL1) of the scan signal in the block DBL1 closest to the scan driver unit 3 has, as shown in FIG. 6, a sharp leading edge and a sharp trailing edge. On the other hand, the waveform Vs(DBLn) of the scan signal in the block DBLn located farthest away from the scan driver unit 3 has, as shown in FIG. 6, a dull leading edge and a dull trailing edge.

In the conventional liquid crystal display module, as shown in the lower part of FIG. 6, video voltages DATA representing respective display data items are transmitted to all video lines at the same timing. Moreover, in the liquid crystal display module, the timings of the scan signal and video voltage are normally determined based on the relationship between the waveform Vg(far) attained at a position located farthest away from the scan driver unit 3 along each scan line G and the lowest potential of the video voltage DATA.

Therefore, a writing time WTne or WTne' required in a case where a waveform exhibits a sharp leading edge and a sharp trailing edge similarly to the waveform Vg(near) attained at a position located closest to the scan driver unit 3 along each scan line G is shorter than a writing time (WTf or WTf') required at a position located farthest away from the scan driver unit 3 along the scan line G.

In the liquid crystal display module of the present embodiment, the transmission timing of a video voltage DATA (DBL1) onto the video lines belonging to the block DBL1 is determined based the relationship between the waveform Vg(DBL1) of a scan signal and the lowest potential of the video voltage DATA(DBL1). The transmission timing of a video voltage DATA(DBLn) onto the block DBLn is determined based on the waveform Vg(DBLn) of the scan signal and the lowest potential of the video voltage DATA(DBLn).

In this way, for example, as shown in FIG. 6, a time instant at which the video voltage DATA(DBL1) in the block DBL1 located closest to the scan driver unit 3 along the scan line G is rewritten, and a time instant at which the video voltage DATA(DBLn) in the block DBLn located farthest away from the scan driver unit 3 along the scanning line G become different from each other by Δt (sec).

In other words, when the transmission timing of a video voltage onto the video lines belonging to the block DBL1 located closest to the scan driver unit 3 along the scanning line G is made earlier by Δt (sec), the shortage in a writing time occurring in the block DBL1 can be compensated.

Consequently, the writing time WT1 or WT1' required in the block DBL1 located closest to the scan driver unit 3 along the scan line G and the writing time WTn or WTn' required in the block DBLn located farthest away from the scan driver unit 3 along the scan line G become nearly equal to each other.

FIG. 6 show the waveforms observed in the block DBL1 located closest to the scan driver unit 3 and the block DBLn located farthest away from it. In reality, the transmission timings of video voltages are designated so that the writing times during which the respective video voltages are written in all the blocks DBL1 to DBLn respectively will be nearly equal to one another.

Figure 7A:
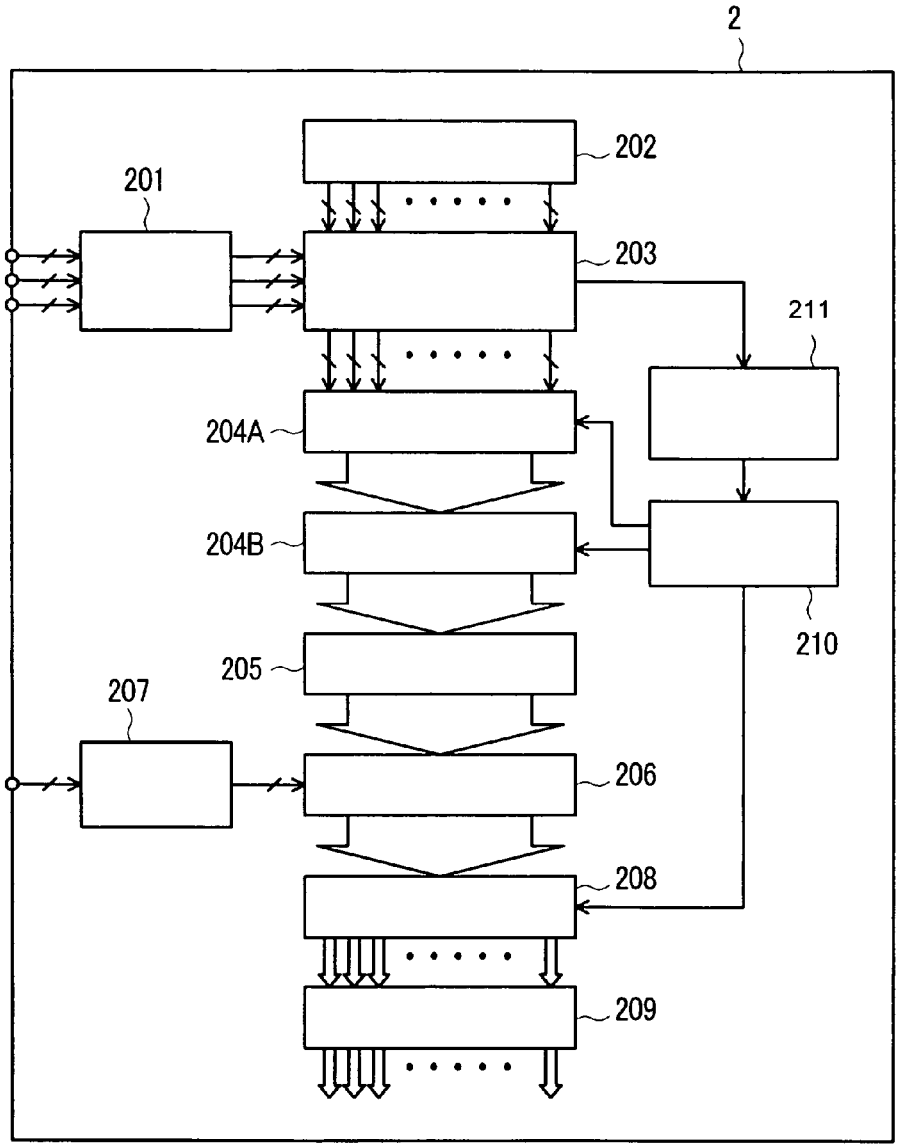
FIG. 7A is a block diagram showing the outline configuration of a data driver IC included in the liquid crystal display module in accordance with the embodiment of the present invention.
Figure 8:
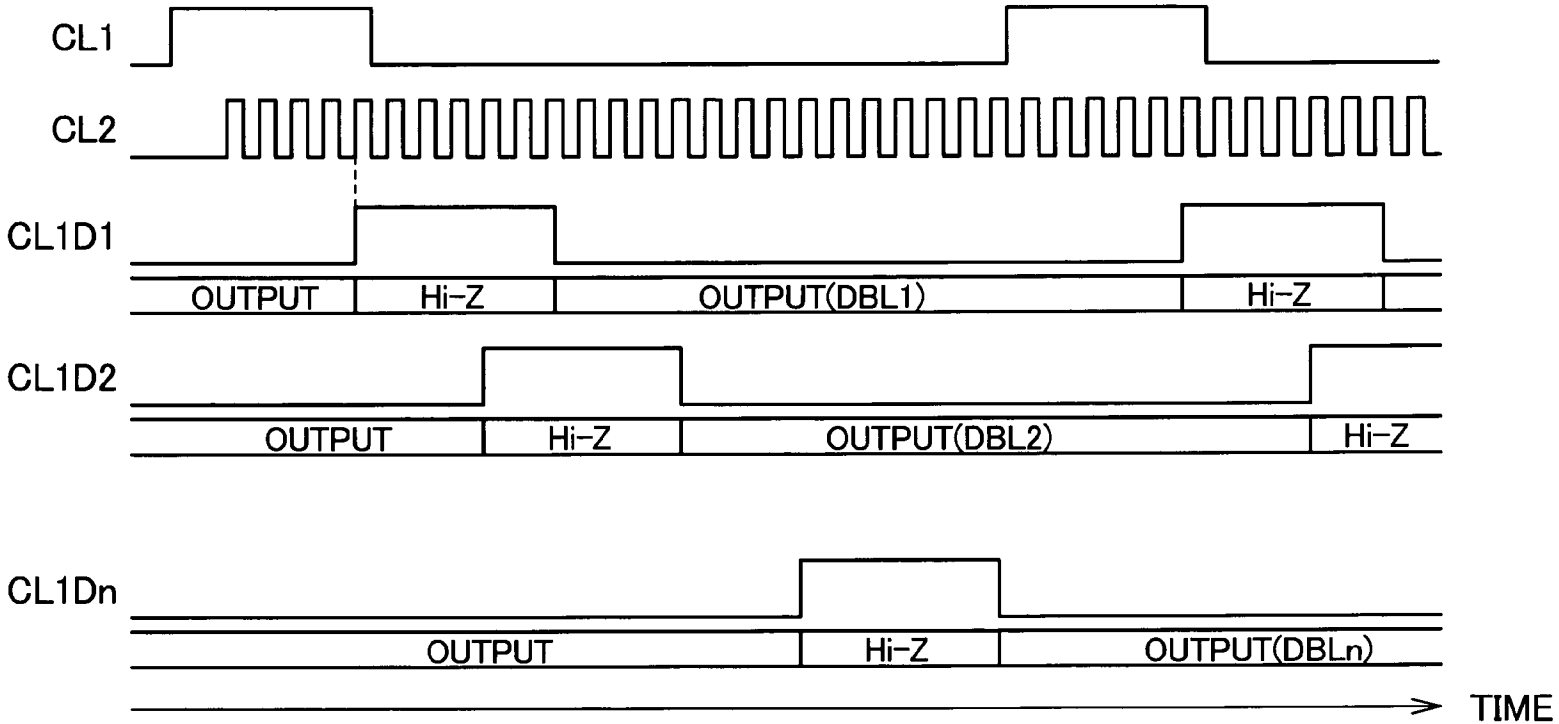
FIG. 8 is an explanatory diagram showing the transmission timings of display data items in the liquid crystal display module in accordance with the embodiment of the present invention.

FIG. 7A is a block diagram showing the outline configuration of a data driver IC included in the liquid crystal display module in accordance with the present embodiment. FIG. 8 is an explanatory diagram showing the transmission timings of display data items in the liquid crystal display module in accordance with the present embodiment.

The data driver unit 2 included in the liquid crystal display module in accordance with the present embodiment includes multiple data driver ICs. The data driver IC includes a data latch circuit 201, a shift register 202, a first latch circuit 203, a second latch circuit 204A, a third latch circuit 204B, a level shift circuit 205, a decoder 206, a gray-scale voltage generation circuit 207, an output circuit 208, a switching circuit 209, an internal control signal production circuit 210 that produces internal control signals, and a delay resistor 211 in which set values needed to produce internal control signals are stored.

In the data driver IC, display data received externally is temporarily held in the data latch circuit 201. The first latch circuit 203 latches successively sent display data items, which express one display line, responsively to respective fetch signals sent from the shift register 202.

The second latch circuit 204A latches display data items, which are held in the first latch circuit 203, responsively to first internal control signals sent from the internal control signal production circuit 210.

The third latch circuit 204B latches display data items, which are held in the second latch circuit 204A, responsively to second internal control signals sent from the internal control signal production circuit 210, and transfers the display data items to the level shift circuit 205.

The level shift circuit 205 changes the signal levels of received display data items and transfers the resultant display data items to the decoder 206.

The decoder 206 selects gray-scale voltages (analog signals), which represent display data items from among gray-scale voltages generated by the gray-scale voltage generation circuit 207 according to the display data items received from the level shift circuit 205, and transfers the gray-scale voltages to the output circuit 208.

The first latch circuit 203 not only transfers display data items to the second latch circuit 204A but also transfers register data items, which represent the transmission timings of the display data items to the blocks DBL1 to DBLn respectively, to the delay register 211.

The delay register 211 transfers information, which is needed to designate the transmission timings, to the internal control signal production circuit 210 according to the register data items.

The internal control signal production circuit 210 products internal control signals on the basis of received information, and transfers the internal control signals to each of the second latch circuit 204A, third latch circuit 204B, and output circuit 208.

The second internal control signal to be produced designates, like any of signals CL1D1 to CD1Dn shown in FIG. 8, the transmission timing of a video voltage to each of the blocks DBL1 to DBLn so that the timing will be synchronous with a dot clock CL2 to be used to latch display data.

The output circuit 208 amplifies gray-scale voltages received from the decoder 206, and transfers the resultant gray-scale voltages to the switching circuit 209 at the timings designated for the respective blocks on the basis of the internal control signals. The switching circuit 209 sequentially transmits the received gray-scale voltages onto the respective video lines D.

As mentioned above, according to the liquid crystal display module of the present embodiment, the video lines are grouped into multiple blocks. The transmission timings of video voltages to the respective blocks are shifted (caused to lag), whereby the data writing times during which data items are written in thin-film transistors (TFT) at respective subpixels juxtaposed in a direction in which each scan line extends can be made equal to one another. Thus, in homogeneity in display or degradation in display quality caused by insufficient writing of a video voltage can be prevented.

Figure 7B:
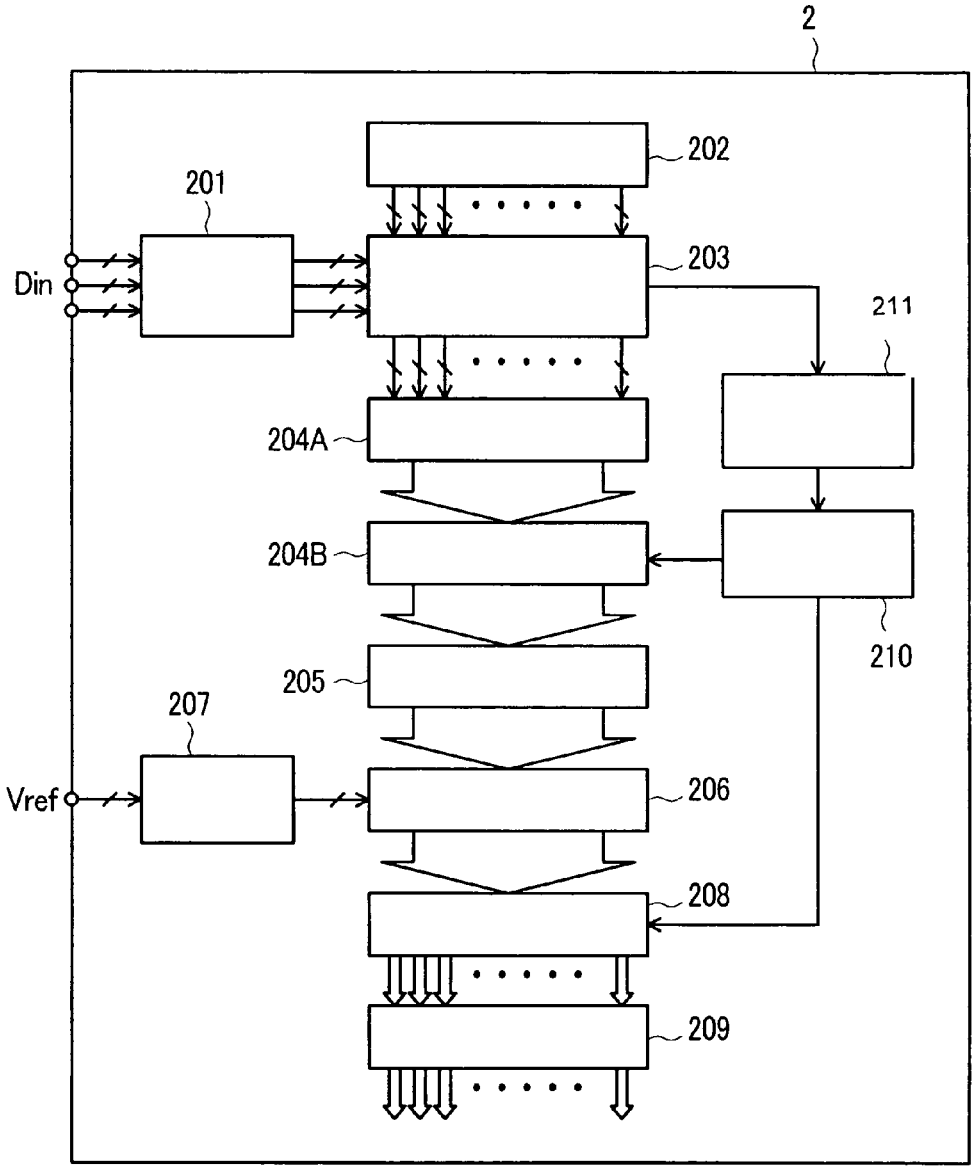
Prior Art FIG. 7B
FIG. 7B is a block diagram showing the outline configuration of a data driver IC included in a conventional liquid crystal display module.
Figure 10:
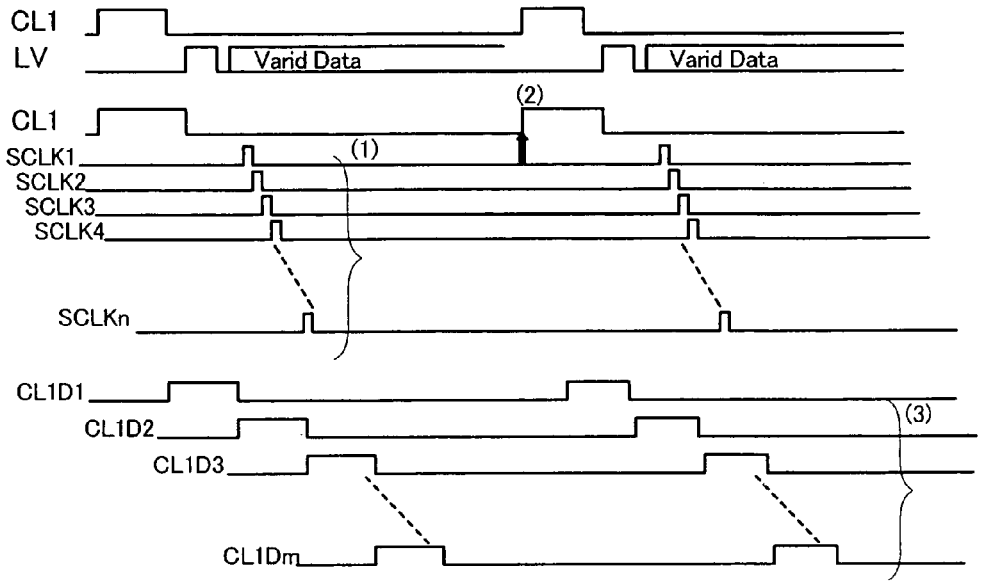
Prior Art FIG. 10
FIG. 10 is an explanatory diagram concerning the latching action of a second latch circuit included in the conventional liquid crystal display module.

FIG. 7B is a block diagram showing the outline configuration of a data driver IC included in a conventional liquid crystal display module. FIG. 10 is an explanatory diagram showing the latching action of the second latch circuit included in the conventional liquid crystal display module.

In the conventional liquid crystal display module, as shown in (1) in FIG. 10, the first latch circuit 203 shown in FIG. 7A sequentially latches display data items responsively to respective fetch signals SCLK1 to SCLKn sent from the shift resistor 202 (namely, latches display data items at different timings). Moreover, as shown in (3) in FIG. 10, the third latch circuit 204B sequentially latches the display data items for respective blocks responsively to internal control signals CL1D1 to CL1Dm sent from the internal control signal production circuit 210 (namely, latches the display data items at different timings).

However, as shown in (2) in FIG. 10, the second latch circuit 204A comprehensively latches the display data items responsively to a latch clock LCLK that is synchronous with a clock CL1.

Consequently, when the bits of display data items expressing a succeeding display line have changed largely from those of display data items expressing a preceding display line, since the second latch circuit 204A comprehensively latches display data items responsively to a clock CL1, numerous circuits go into action at the same timing. Eventually, a momentary current is generated.

The momentary current causes a supply voltage to fluctuate, and convolutes noise to the supply voltage. At the worst, there is a fear that display data may be lost or reliability may be impaired.

In the present embodiment, in order to solve the above problem, the first latch circuit 203 latches succeeding display data items for the respective blocks, and preceding display data items for the respectively blocks latched into the second latch circuit 204A are transferred to the third latch circuit 204B. Thereafter, the display data items for the respective blocks are latched from the first latch circuit 203 into the second latch circuit 204A.

In the present embodiment, the second latch circuit 204A sequentially latches the display data items for the respective blocks responsively to the respective first internal control signals LCLK1 to LCLKn sent from the internal control signal production circuit 210 (namely, latches the display data items at different timings).

Figure 9:
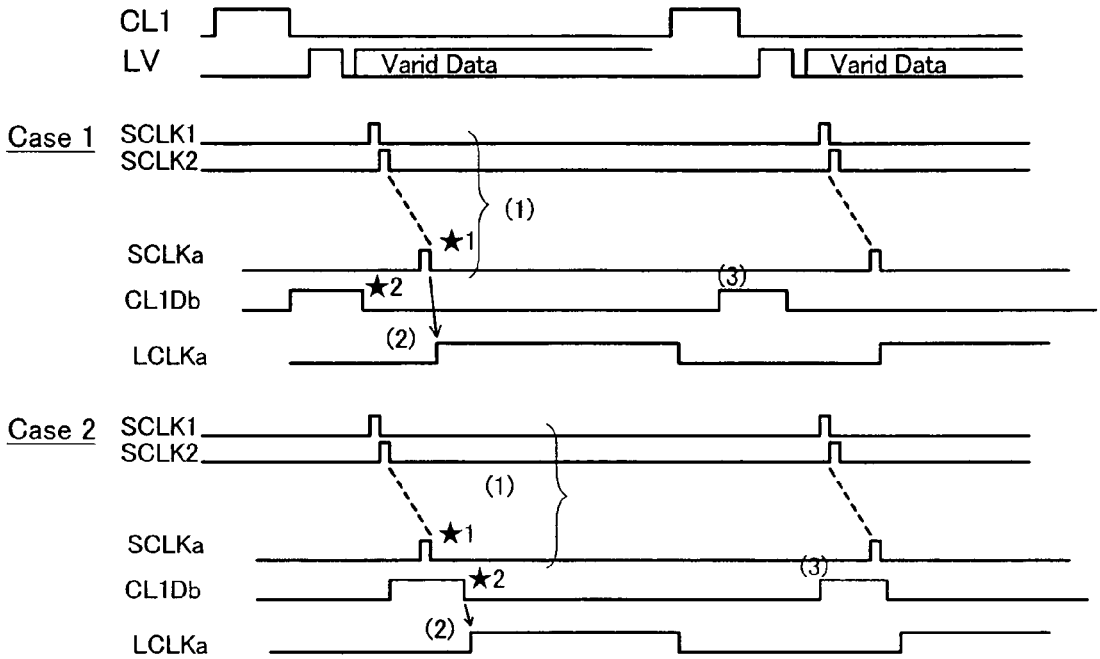
FIG. 9 is an explanatory diagram concerning the latching action of a second latch circuit included in the liquid crystal display module in accordance with the embodiment of the present invention.

Consequently, in the present embodiment, the internal control signal production circuit 210 produces the first internal control signals LCLK1 to LCLKn each of which rises synchronously with whichever of the trailing edge of the fetch signal, responsively to which display data is fetched for the last video line among those of the blocks DBL1 to DBLn in the first latch circuit 203, and the trailing edges of the second internal control signals CL1D1 to CL1Dm, responsively to which display data items for the respective blocks DBL1 to DBLn are latched in the third latch circuit 204B, that comes last as shown in FIG. 9.

FIG. 9 is an explanatory diagram indicating the latching action of the second latch circuit included in the liquid crystal display module in accordance with the present embodiment.

Case 1 in FIG. 9 is a case where the trailing edge of the fetch signal responsively to which display data is fetched for the last video line among those of the blocks DBL1 to DBLn comes last. As shown in (2) relevant to Case 1 in FIG. 9, synchronously with the trailing edge of the fetch signal SCLKa responsively to which display data is fetched for the last video line LV among those of the blocks DBL1 to DBLn, the first internal control signals LCLKa rises, and the display data items for the respectively blocks DBL1 to DBLn that have already been latched into the first latch circuit 203 are latched into the second latch circuit 204A.

Case 2 in FIG. 9 is a case where the trailing edges of the second internal control signals CL1D1 to CL1Dm responsively to which the third latch circuit 204B latches display data items for the respective blocks DBL1 to DBLn come last. As shown in (2) relevant to case 2 in FIG. 9, synchronously with the trailing edges of the second internal control signals CL1Db, the first internal control signals LCLKa rise, and the display data items for the respective blocks DBL1 to DBLn that have already been latched into the first latch circuit 203 are latched into the second latch circuit 204A.

In either case 1 or case 2, the first internal control signals LCLK1 to LCLKn fall synchronously with the clock CL1.

Figure 11:
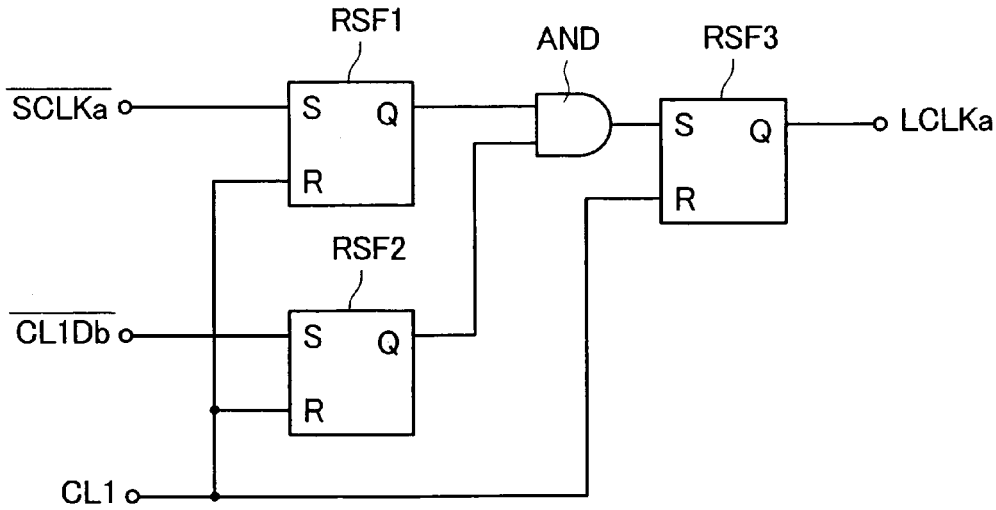
FIG. 11 is an explanatory diagram concerning a method of producing internal control signals employed in the liquid crystal display module in accordance with the embodiment of the present invention.

The first internal control signals SCLKa can be produced by, for example, the circuitry shown in FIG. 11.

The circuit shown in FIG. 11 includes an R-S flip-flop circuit (RSF1) that is reset with a reverse signal of each of the fetch signals SCLKa and is reset with the clock CL1, an R-S flip-flop circuit RSF2 that is reset with a reverse signal of each of the second internal control signals CL1Db and reset with the clock CL1, an AND circuit AND that receives a Q output of the R-S flip-flop circuit RSF1 and a Q output of the R-S flip-flop circuit RSF2, and an R-S flip-flop circuit RSF3 that is reset with an output of the AND circuit AND and reset with the clock CL1.

As mentioned above, in the present embodiment, even the second latch circuit 204A sequentially latches display data items for the respective blocks responsively to the internal control signals LCLKD1 to LCLKDn sent from the internal control signal production circuit 210. Even when the bits of display data items expressing a succeeding display line have largely changed from those of display data items expressing a preceding display line, numerous circuits will not go into action simultaneously at the same timing. Consequently, a peak current can be minimized.

The first internal control signals SCLK1 to SCLKn or the second internal control signals CL1D1 to CL1Dm have been described to be signals that are normally low and that are validated during a period during which they are held high. When the fetch signals or the second internal control signals CL1D1 to CL1Dm are signals that are normally high and that are invalidated during a period during which they are held low, the first internal control signals SCLK1 to SCLKn are signals that rise synchronously with whichever of the trailing edges of the fetch signals and the trailing edges of the second internal control signals CL1D1 to CL1Dm that comes last.

The internal control signal production circuit included in the liquid crystal display module in accordance with the present embodiment will be described below.

Figure 12:
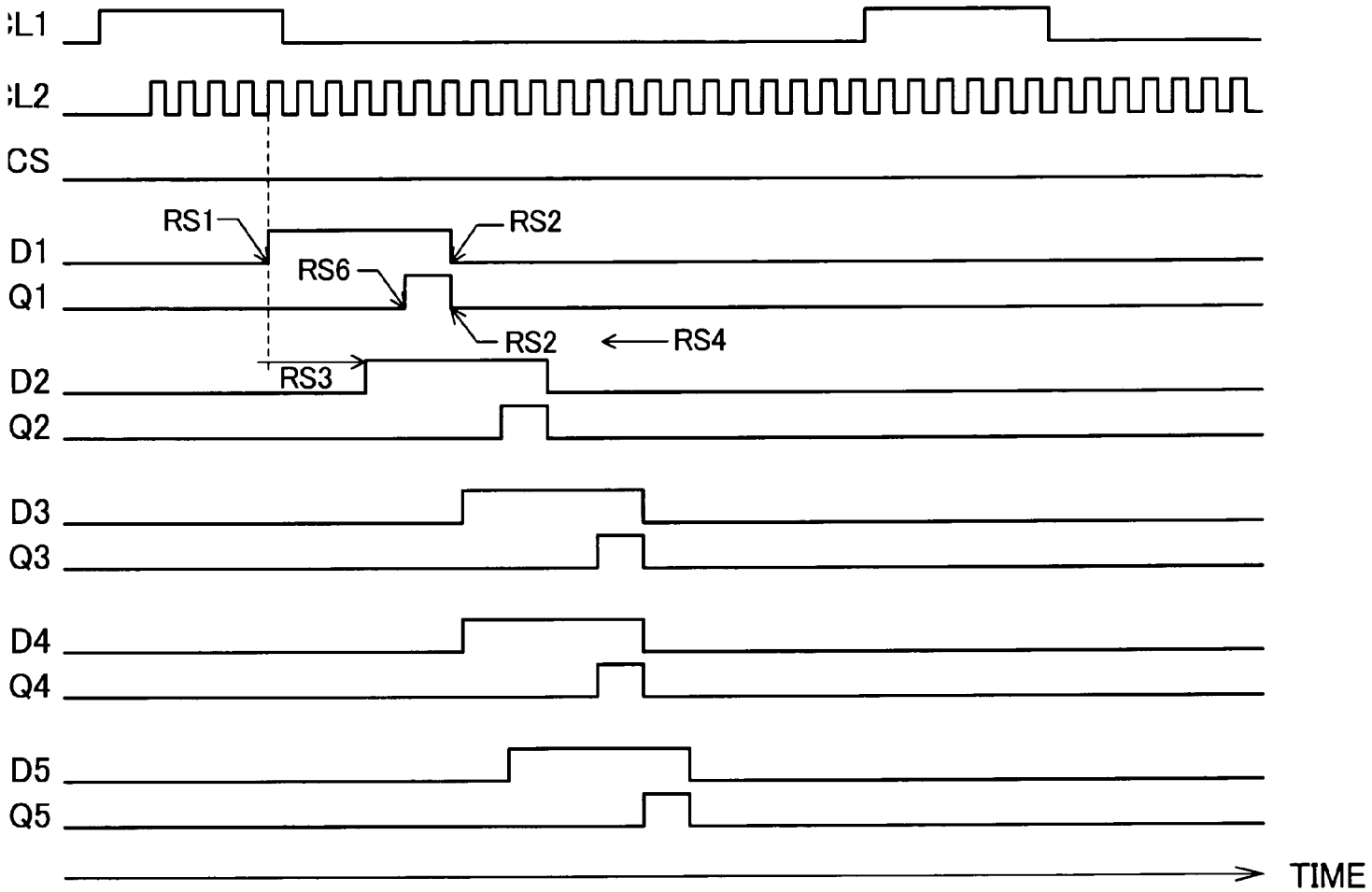
FIG. 12 is an explanatory diagram concerning the method of producing internal control signals employed in the liquid crystal display module in accordance with the embodiment of the present invention.
Figure 13:
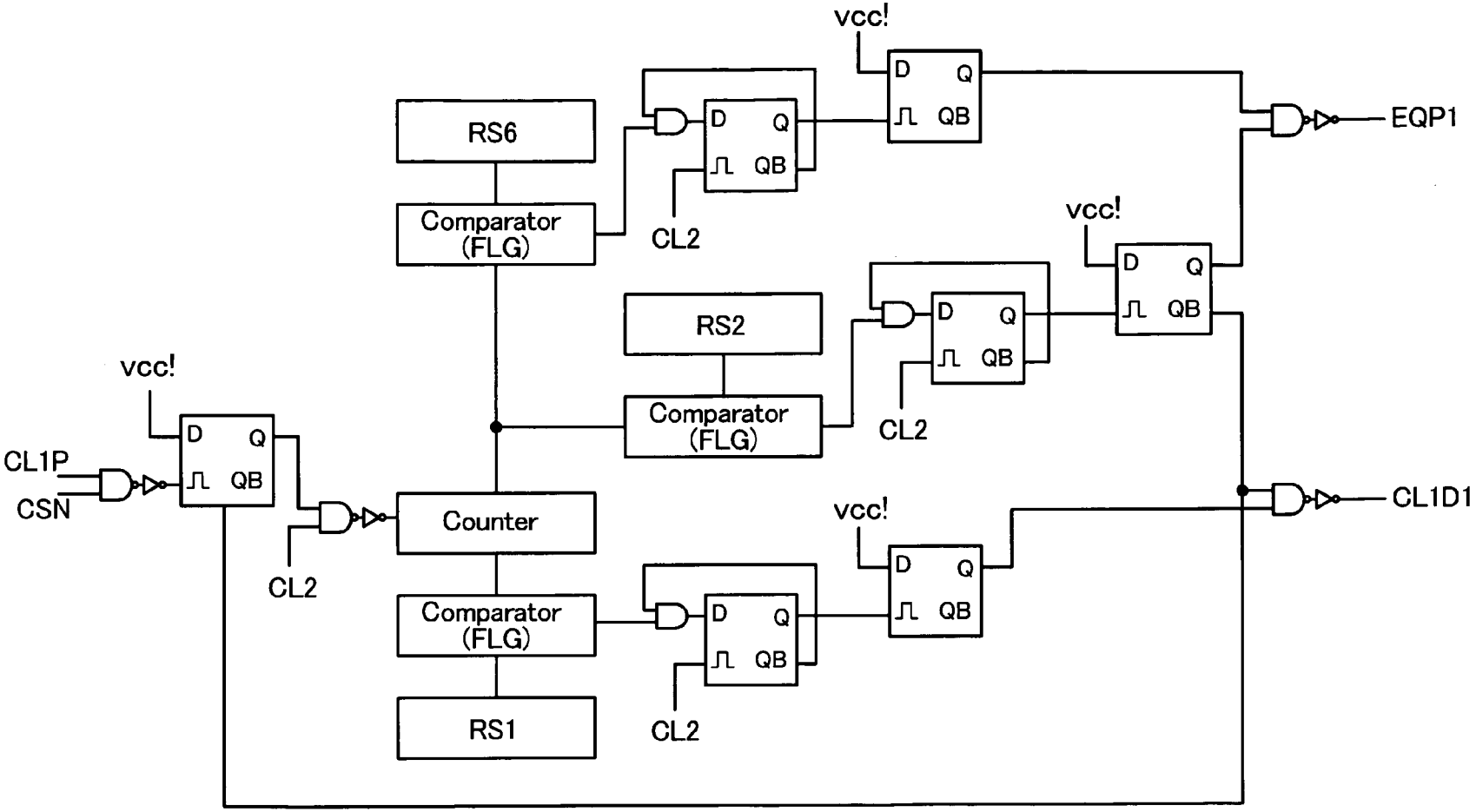
FIG. 13 is a circuit diagram showing an example of the configuration of an initial stage of an internal control signal production circuit included in the liquid crystal display module in accordance with the embodiment of the present invention.
Figure 14:
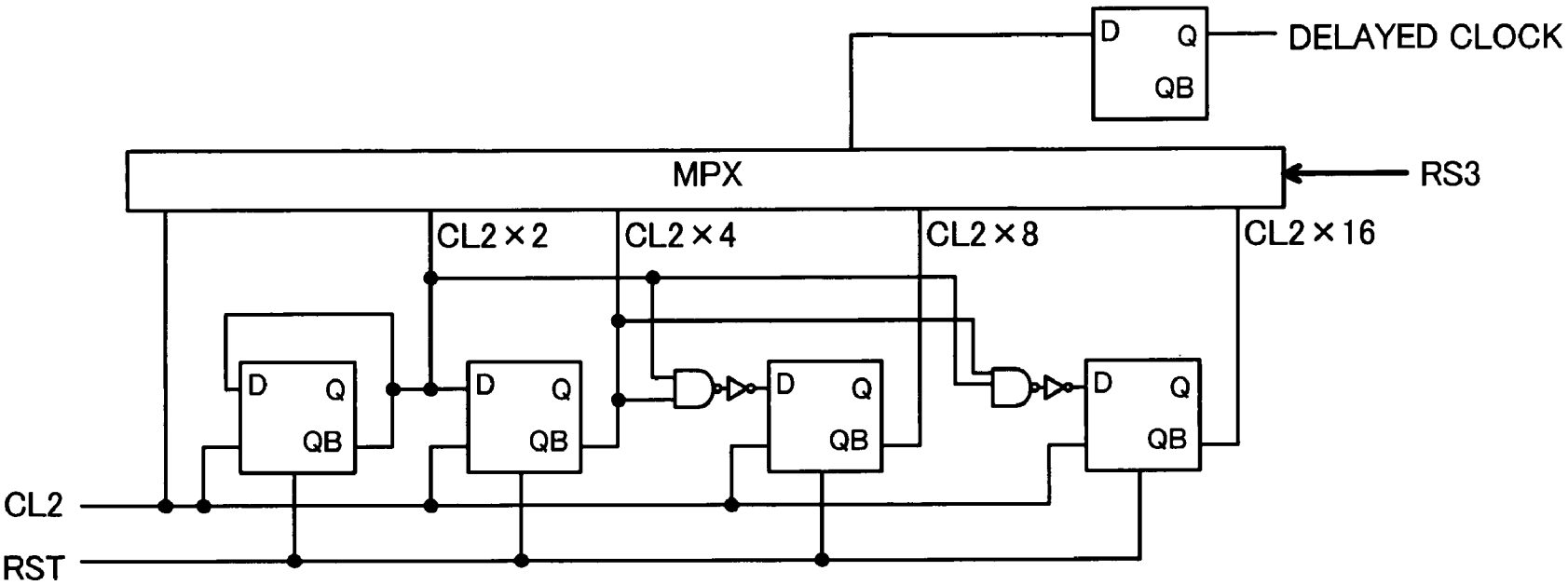
FIG. 14 is a circuit diagram showing an example of the initial stage of the internal control signal production circuit included in the liquid crystal display module in accordance with the embodiment of the present invention.
Figure 15:
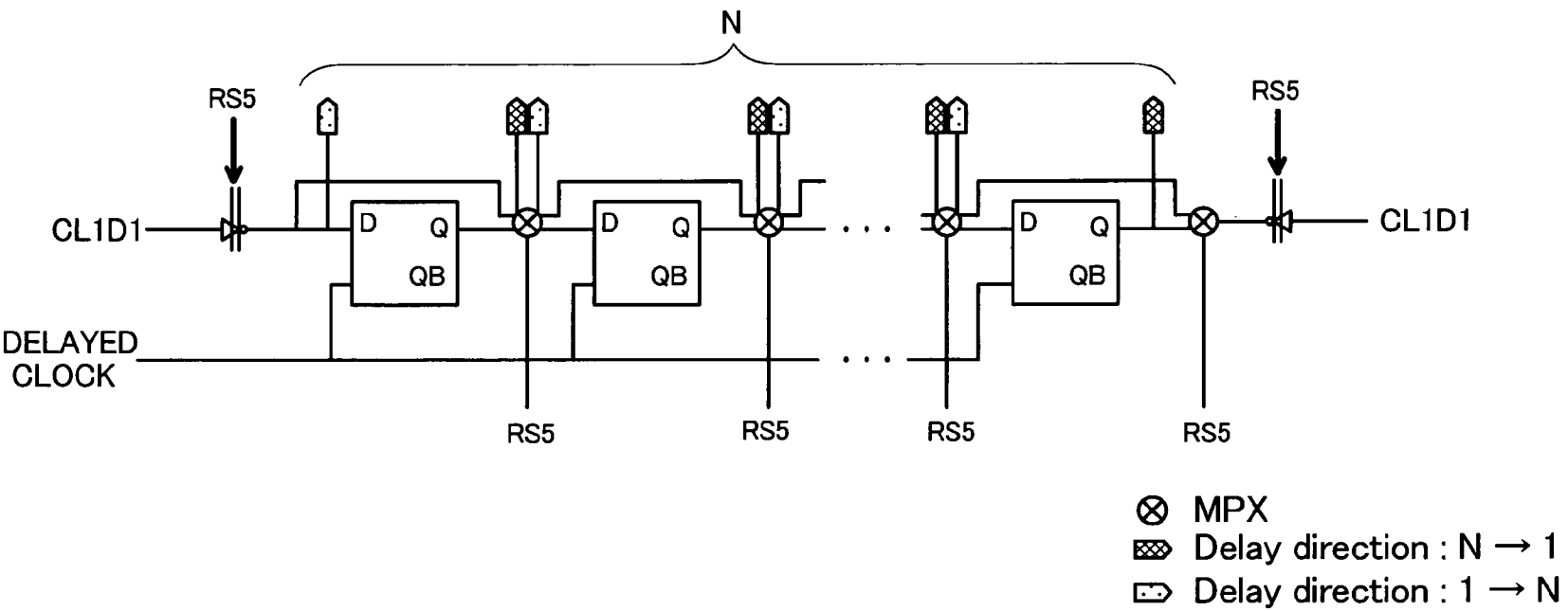
FIG. 15 is a circuit diagram showing an example of the configuration of a second stage and subsequent stages of the liquid crystal display module in accordance with the embodiment of the present invention.

FIG. 12 is an explanatory diagram concerning a method of producing internal control signals in the liquid crystal display module in accordance with the present embodiment. FIG. 13 is a circuit diagram showing an example of the configuration of an initial stage of the internal control signal production circuit included in the liquid crystal display module in accordance with the present embodiment. FIG. 14 is a circuit diagram showing an example of the configuration of a clock circuit for a shift register included in the internal control signal production circuit included in the liquid crystal display module in accordance with the present embodiment. FIG. 15 is a circuit diagram showing an example of the configuration of a second stage and subsequent stages of the internal control signal production circuit included in the liquid crystal display module in accordance with the present embodiment.

For production of the second internal control signals by the internal control signal production circuit 210, the rise times RS1 shown in FIG. 12 of the internal control signals CL1D1 to CL1D5, the fall times RS2 of the internal control signal CL1D1 and an equalizing signal EQ1, a lag time RS3, whether grouping into delay blocks is performed RS4, a direction RS5 in which the second internal control signals lag, and the equalizing signals EQ have to be designated.

At this time, the rise times RS1 of the internal control signals and the fall times RS2 are designated with the number of counted clocks CL2 that is held in a register. Moreover, the lag time RS3 is designated with each of the fetch signals that exhibit a fraction of the frequency of the clock CL2 and that are sent from the shift register 202.

Whether grouping into blocks is performed RS4 refers to, for example, whether the second internal control signals are caused to lag behind preceding signals. When the second internal control signals are caused to lag behind the preceding internal control signals, 1 is designated. Otherwise, 0 is designated. As for a direction RS5 in which the internal control signals are caused to lag, whether the internal control signals are caused to lag in a direction from the first block DBL1 to the n-th block DBLn or in an opposite direction is designated.

At this time, the internal control signal CL1D1 to be transmitted first to a block is produced by a counter circuit, and the other internal control signals CL1D2 to CL1D5 are produced by the shift register.

The counter circuit that produces the internal control signal CL1D1 to be transmitted first to a block and the equalizing signal EQP1 has, for example, the configuration shown in FIG. 13. The counter circuit produces the internal control signal CL1D1 and equalizing signal EQP1 using a flip-flop circuit, the designated rise times RS1 of the internal control signals, the designated fall times RS2, the designated fall time RS6 of an equalizing signal, a horizontal sync clock CL1P received from a timing controller, and the clock CL2.

Moreover, for production of the other internal control signals, a shift register clock circuit and the shift register designate lag times, by which the internal control signals are caused to lag behind the internal control signal CL1D1, on the basis of the internal control signal CL1D1 produced by the counter circuit.

At this time, the shift register clock circuit has, for example, the configuration shown in FIG. 14. The shift register clock circuit produces delay clocks, of which cycles are twice, four times, eight times, or sixteen times longer than one cycle of the clock CL2, using the one cycle of the clock CL2 as a reference.

The shift register has, for example, the configuration shown in FIG. 15. The shift register produces the internal control signals CL1D2 to CL1DN, which are transmitted to blocks other than the first block, using the internal control signal CL1D1 produced by the counter circuit, the delay clocks produced by the shift register clock circuit, and the designation RS4 on whether grouping into delay blocks is performed, and the designated direction RS5 in which the internal control signals are caused to lag.

Figure 16:
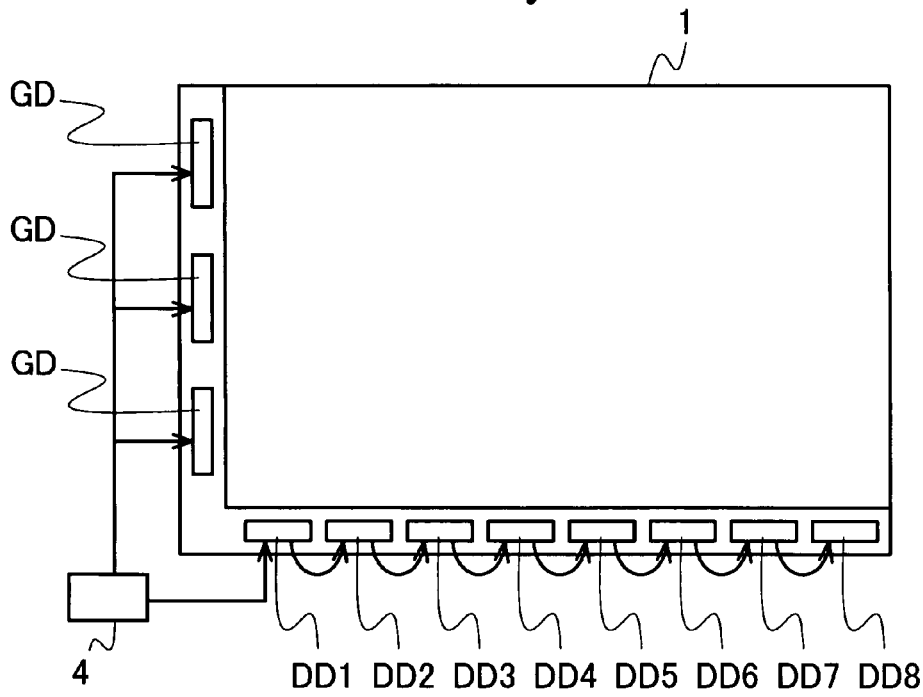
FIG. 16 is an explanatory diagram concerning a transfer method to be adopted in a case where scan drivers are disposed on one side alone of the liquid crystal display module in accordance with the embodiment of the present invention.
Figure 17:
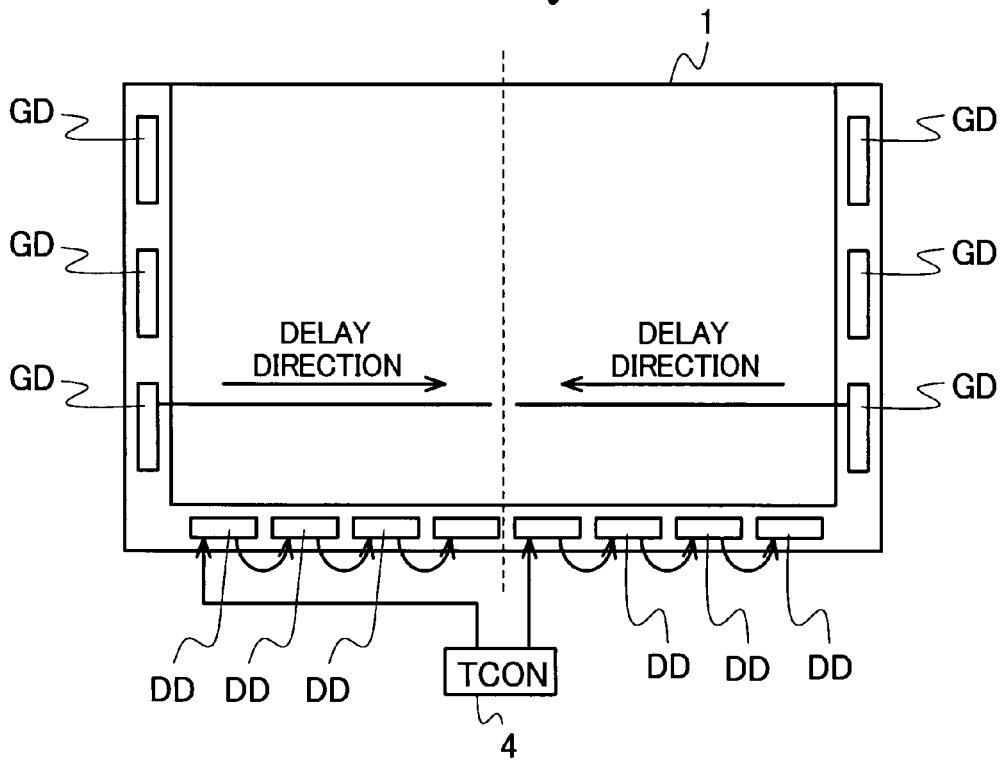
FIG. 17 is an explanatory diagram concerning a transfer method to be adopted in a case where the scan drivers are disposed on two opposed sides of the liquid crystal display module in accordance with the embodiment of the present invention.

FIG. 16 and FIG. 17 are illustrative explanatory diagrams concerning a method of transferring display data. FIG. 16 shows an example of the transferring method to be applied to a case where scan drivers are disposed on one side of a liquid crystal display panel. FIG. 17 shows an example of the transferring method to be applied to a case where scan drivers are disposed on two sides of the liquid crystal display panel.

According to the aforesaid method of transmitting a gray-scale voltage, the transmission timings of gray-scale voltages to respective blocks are caused to lag. Moreover, a direction in which the transmission timings are caused to lag can be controlled.

A typical liquid crystal panel to be adopted as the liquid crystal display panel 1 has, for example, as shown in FIG. 16, scan drivers GD disposed on one side of the display panel. A scan signal placed on each scan line propagates unidirectionally. In the case of the liquid crystal display panel, display data and register data are transferred from a timing controller 4 to data drivers in sequence from the data driver DD1 located closest to the scan driver to the data driver DD8 located farthest away from the scan driver. Internal control signals whose lag times get larger as they recede farther from the scan driver are produced.

However, the liquid crystal display panel 1 may be of a type having scan drivers GD disposed on two opposite sides of the panel as shown in FIG. 17.

In the case of the liquid crystal display panel, as shown in FIG. 17, two kinds of scan lines on which respective lagging directions are opposite are laid. When a direction in which internal control signals are caused to lag can be controlled as mentioned above, the transmission timings of display data items to respective blocks can be caused to lag according to the lagging direction on a scan line that passes through the blocks.

Moreover, the embodiment has been described on the assumption that the present invention is applied to a liquid crystal display device. The present invention is not limited to the liquid crystal display device. Needless to say, the present invention may be applied to electroluminescent display devices (including an organic electroluminescent display device).

The present invention has been concretely described in relation to the embodiment. The present invention is not limited to the embodiment but can be modified in various manners without a departure from the gist thereof.

FIG. 1
1: LIQUID CRYSTAL DISPLAY PANEL
2: DATA DRIVER UNIT
3: SCAN DRIVER UNIT
5: POWER CIRCUIT
FIG. 2
2: DATA DRIVER UNIT
3: SCAN DRIVER UNIT
FIG. 4
2: DATA DRIVER UNIT
3: SCAN DRIVER UNIT
FIG. 5
TIME INSTANT
FIG. 6
TIME INSTANT
FIG. 7A
201: DATA LATCH CIRCUIT
202: SHIFT REGISTER
203: FIRST LATCH CIRCUIT
204A: SECOND LATCH CIRCUIT
204B: THIRD LATCH CIRCUIT
205: LEVEL SHIFT CIRCUIT
206: DECODER
207: GRAY-SCALE VOLTAGE GENERATION CIRCUIT
208: OUTPUT CIRCUIT
209: SWITCHING CIRCUIT
210: INTERNAL CONTROL SIGNAL PRODUCTION CIRCUIT
211: DELAY REGISTER
FIG. 7B
201: DATA LATCH CIRCUIT
202: SHIFT REGISTER
203: FIRST LATCH CIRCUIT
204A: SECOND LATCH CIRCUIT
204B: THIRD LATCH CIRCUIT
205: LEVEL SHIFT CIRCUIT
206: DECODER
207: REFERENCE VOLTAGE GENERATION CIRCUIT
208: OUTPUT CIRCUIT
209: SWITCHING CIRCUIT
210: INTERNAL CONTROL SIGNAL PRODUCTION CIRCUIT
211: DELAY REGISTER
FIG. 8
出力:OUTPUT
時刻:TIME INSTANT
FIG. 9
マルチディレイブロックの～:SIGNAL SCLK TO BE TRANSMITTED TO LAST ONE OF MULTIPLE DELAY BLOCKS
*1 *2 のうち立下りの遅い～:LATCH PULSE 1 IS PRODUCED SYNCHRONOUSLY WITH LAST TRAILING EDGE *1 AMONG TRAILING EDGES *1 AND *2. LATCH PULSE 1 IS SYNCHRONIZED TO NEXT CLI1
このCase においては～:LATCH PULSE 1 IS PRODUCED SYNCHRONOUSLY WITH TRAILING EDGE *2
FIG. 12
TIME INSTANT
FIG. 13
レジスタ:REGISTER
立ち下がり:FALL TIME
コンパレータ:COMPARATOR
生成:PRODUCTION
カウンタ:COUNTER
立ち上がり:RISE TIME
FIG. 14
DELAY CLOCK
FIG. 15
DELAY CLOCK
LAGGING DIRECTION IS N→1
LAGGING DIRECTION IS 1→N
FIG. 17
LAGGING DIRECTION
FIG. 1
1: LIQUID CRYSTAL DISPLAY PANEL
2: DATA DRIVER UNIT
3: SCAN DRIVER UNIT
5: POWER CIRCUIT
FIG. 2
2: DATA DRIVER UNIT
3: SCAN DRIVER UNIT
FIG. 4
2: DATA DRIVER UNIT
3: SCAN DRIVER UNIT
FIG. 5
TIME INSTANT
FIG. 6
TIME INSTANT
FIG. 7A
201: DATA LATCH CIRCUIT
202: SHIFT REGISTER
203: FIRST LATCH CIRCUIT
204A: SECOND LATCH CIRCUIT
204B: THIRD LATCH CIRCUIT
205: LEVEL SHIFT CIRCUIT
206: DECODER

207: GRAY-SCALE VOLTAGE GENERATION CIRCUIT
208: OUTPUT CIRCUIT
209: SWITCHING CIRCUIT
210: INTERNAL CONTROL SIGNAL PRODUCTION CIRCUIT
211: DELAY REGISTER
FIG. 7B
201: DATA LATCH CIRCUIT
202: SHIFT REGISTER
203: FIRST LATCH CIRCUIT
204A: SECOND LATCH CIRCUIT
204B: THIRD LATCH CIRCUIT
205: LEVEL SHIFT CIRCUIT
206: DECODER
207: REFERENCE VOLTAGE GENERATION CIRCUIT
208: OUTPUT CIRCUIT
209: SWITCHING CIRCUIT
210: INTERNAL CONTROL SIGNAL PRODUCTION CIRCUIT
211: DELAY REGISTER
FIG. 8
出力:OUTPUT
時刻:TIME INSTANT
FIG. 9
マルチディレイブロックの～:SIGNAL SCLK TO BE TRANSMITTED TO LAST ONE OF MULTIPLE DELAY BLOCKS
*1 *2 のうち立下りの遅い～:LATCH PULSE 1 IS PRODUCED SYNCHRONOUSLY WITH LAST TRAILING EDGE *1 AMONG TRAILING EDGES *1 AND *2. LATCH PULSE 1 IS SYNCHRONIZED TO NEXT CLI1
このCase においては～:LATCH PULSE 1 IS PRODUCED SYNCHRONOUSLY WITH TRAILING EDGE *2
FIG. 12
TIME INSTANT
FIG. 13
レジスタ:REGISTER
立ち下がり:FALL TIME
コンパレータ:COMPARATOR
生成:PRODUCTION
カウンタ:COUNTER
立ち上がり:RISE TIME
FIG. 14
DELAY CLOCK
FIG. 15
DELAY CLOCK
LAGGING DIRECTION IS N→1
LAGGING DIRECTION IS 1→N
FIG. 17
LAGGING DIRECTION

What is claimed is:

1. A display device comprising:

a display panel including a plurality of video lines;

a plurality of data drivers that transmit a video voltage to each of the video lines; and a display control circuit that controls or drives the plurality of data drivers, wherein:

a data driver includes:

an internal control signal production circuit that groups the plurality of video lines into a plurality of blocks, and produces first internal control signals and second internal control signals which are used to make the transmission timings of video voltages onto video lines, which belong to the blocks, different from one another among the blocks;

a first latch circuit that sequentially latches display data items which express one display line and which are received successively externally;

a second latch circuit that latches the display data items which have been latched into the first latch circuit;

a third latch circuit that latches the display data items, which have been latched into the second latch circuit and are associated with the respective blocks, at timings which are different from one another among the blocks;

and a decoder that converts the display data items, which have been latched into the third latch circuit, into video voltages;

the second latch circuit latches the display data items, which have been latched into the first latch circuit, at timings that are different from one another among the blocks;

before the first latch circuit latches succeeding display data items associated with the blocks, the second latch circuit latches display data items that have already been latched into the first latch circuit;

and before the second latch circuit latches succeeding display data items from the first latch circuit, the third latch circuit latches display data items that have already been latched into the second latch circuit;

the first latch circuit latches display data items responsively to fetch signals;

the second latch circuit latches display data items, which have been latched into the first latch circuit, responsively to first internal control signals produced by the internal control signal production circuit;

the third latch circuit latches display data items, which have been latched into the second latch circuit, responsively to second internal control signals produced by the internal control signal production circuit;

the first internal control signals are signals that are synchronous with whichever one of the fetch signals, responsively to which the last display data among display data items associated with the blocks is latched, and the second internal control signals, responsively to which the display data items associated with the blocks are latched, that are invalidated last.

2. The display device according to claim 1, wherein the first internal control signals are signals that rise synchronously with the trailing edge of the fetch signals responsively to which the last display data among the display data items associated with the blocks is latched.

3. The display device according to claim 1, wherein the first internal control signals are signals that rise synchronously with the trailing edges of the second internal control signals responsively to which the display data items associated with the blocks are latched.

4. The display device according to claim 3, wherein the first internal control signals rise synchronously with a transmission timing control clock.

5. The display device according to claim 1, wherein:

the display panel includes a plurality of scan lines and scan drivers that transmit a scan signal onto each of the scan lines; and the internal control signal production circuit causes the transmission timings of video voltages to lag in sequence from a block located closest to each scan driver to a block located farthest away from the scan driver.

6. The display device according to claim 1, wherein the display device is a liquid crystal display device, and the display panel is a liquid crystal display panel.

* * * * *